US006733364B2

(12) United States Patent
Griffiths

(10) Patent No.: US 6,733,364 B2
(45) Date of Patent: May 11, 2004

(54) COMPUTER CONTROLLED GRINDING MACHINE

(75) Inventor: Selwyn Jonathan Griffiths, Nothampton (GB)

(73) Assignee: Unova U.K. Limited, Buckinghamshire (GB)

( * ) Notice: Subject to any disclaimer, the term of this patent is extended or adjusted under 35 U.S.C. 154(b) by 0 days.

(21) Appl. No.: 10/148,575

(22) PCT Filed: Dec. 6, 2001

(86) PCT No.: PCT/GB00/04651

§ 371 (c)(1),
(2), (4) Date: May 31, 2002

(87) PCT Pub. No.: WO01/41971

PCT Pub. Date: Jun. 14, 2001

(65) Prior Publication Data

US 2002/0182979 A1 Dec. 5, 2002

(30) Foreign Application Priority Data

Dec. 6, 1999 (GB) ..... 9928825

(51) Int. Cl.[7] ..... B24B 49/00
(52) U.S. Cl. ..... 451/5
(58) Field of Search ..... 451/5, 49, 50, 451/10, 11, 26; 200/164, 175, 193, 187

(56) References Cited

U.S. PATENT DOCUMENTS 4,747,236 A 5/1988 Wedeniwski
4,791,575 A 12/1988 Watts
5,773,731 A * 6/1998 Sakakura et al. ..... 73/865.8
5,919,081 A * 7/1999 Hykes et al. ..... 451/11
6,071,049 A * 6/2000 Janssen ..... 409/132
6,411,861 B1 * 6/2002 Clewes et al. ..... 700/164
6,511,364 B2 * 1/2003 Ido et al. ..... 451/10

FOREIGN PATENT DOCUMENTS

GB 2303091 2/1997
GB 2312387 10/1997
GB 2321026 7/1998
JP 5301155 A 11/1993

OTHER PUBLICATIONS

JP2000–288895–A with English translation –Oct. 2000.*

* cited by examiner

*Primary Examiner*—George Nguyen
(74) *Attorney, Agent, or Firm*—Reising, Ethington, Barnes, Kisselle, P.C.

(57) ABSTRACT

A computer controlled grinding machine programmed so as to control the machine by calculating the wellhead demand positions which takes into account the difference in height between the workpiece axis of rotation and the grinding wheel axis of rotation to produce a height adjusted value for P. The following equation is used to compute the position demand values for a crankpin of a crankshaft, namely: $P=(T^*¿\ \cos A)+\sqrt{(R+r)^2-((T^*¿\ \sin A)+H)^2})$, where P is the eight adjusted) demand position of the grinding wheel at each instant; R is the current radius of the grinding wheel; r is the target radius for the crankpin (18); T is the throw of the crankpin around the main crankshaft axis (16); A is the angular position of the crankshaft relative to the start position; and H is the vertical height between the two axes (the height error). The value for P is typically calculated for each of 3600 angular positions during one revolution of the crankshaft.

12 Claims, 1 Drawing Sheet

H = Height Adjust $P = (T^*\cos A)+\sqrt{((R+r)^2-((T^*\sin A)+H)^2)}$

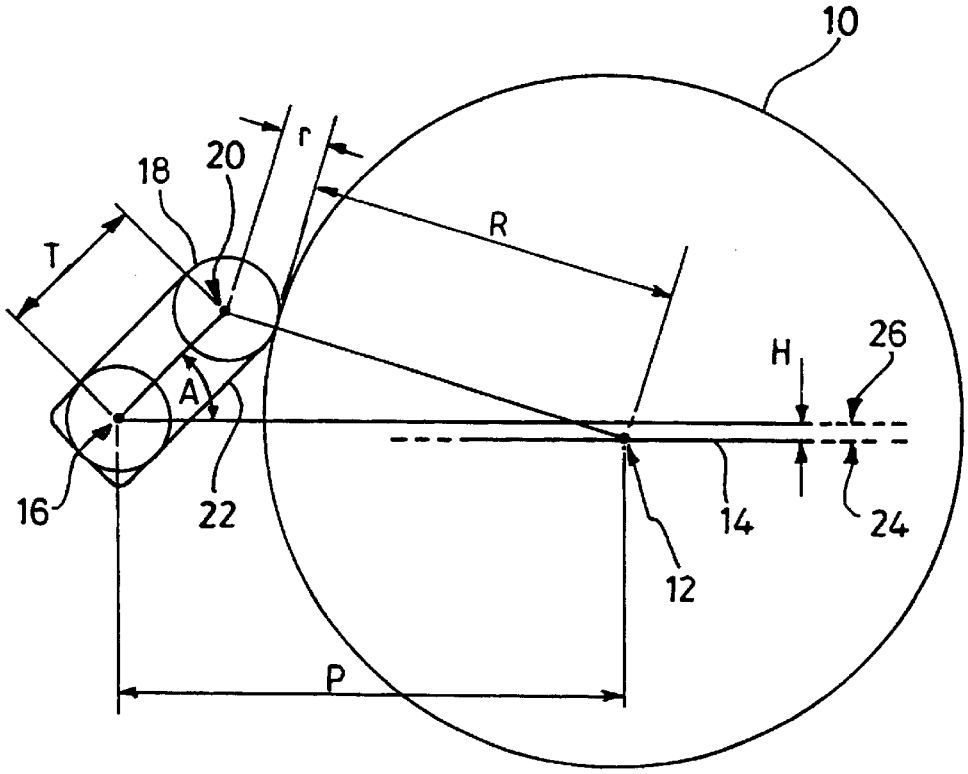
H = Height Adjust
$$P = (T^{*}\cos A) + \sqrt{((R+r)^2 - ((T^{*}\sin A) + H)^2)}$$

COMPUTER CONTROLLED GRINDING MACHINE

FIELD OF INVENTION

This invention concerns the grinding of workpieces such as crankpins and the cam regions of cam shafts, where the grinding wheel performing the grinding is moved towards and away from the axis about which the workpiece is rotating so as to maintain engagement with the surface thereof which is to be ground, as the workpiece rotates around its main axis such as in the case of a crankpin which precesses around the main crankshaft axis, as the latter rotates.

BACKGROUND TO THE INVENTION

The advance and withdrawal of the grinding wheel is normally under computer control and with the current development of grinding machines, errors which hitherto were present in ground workpieces have been largely eliminated by appropriate programming and secondary errors which were previously masked by the larger process errors, have now begun to be revealed.

Errors such as out of roundness of 1 or 2 microns, can result in unwelcome wear of a final component such as between a crankpin and lower big end bearing.

Errors which have already been accommodated, can arise from the varying height of the axis of the workpiece region which is being ground (such as the orbital movement of a crankpin as the crankshaft rotates), relative to the horizontal plane containing the axis about which the grinding wheel rotates. Typically the throw of a crankshaft is the order of a few centimeters and there is thus a considerable variation in height of the axis of the pin relative to the horizontal plane containing the wheel axis of rotation as the pins are rotated due to the rotation of the crankshaft. The grinding wheel is moved towards and away from the crankshaft so as to maintain the grinding contact with the surface of the pin at all times as the latter is rotated around the main crankshaft axis, but, assuming that the crankpin axis lies in the same horizontal plane as the axis of rotation of the grinding wheel, there are only two points during each rotation of the crankshaft when the pin axis also occupies that same plane. These are at 3 o'clock and 9 o'clock positions. At the 12 o'clock and 6 o'clock positions, the pin axis will be at the maximum displacement above and below the plane and at all intermediate positions, the height of the pin will vary relative to the plane.

The reference to a horizontal plane presupposes that the movement of the grinding wheel is in a horizontal sense without any divergence therefrom. This is normally the case but for the avoidance of doubt, it is to be understood that if the locus of the grinding wheel axis as the latter is moved towards and away from the workpiece, is in a plane which is not horizontal, the same considerations still apply with regard to the alignment of the crankshaft axis with the wheel axis, except that the "3 o'clock" and "9 o'clock" positions now correspond to when the crankpin axis lies within the plane containing the path of the movement of the wheel axis.

Computer controlled grinding machines have been programmed to alter the wheelhead demand positions during the crankpin rotation, to compensate for the errors which can result from the varying height of the crankpin as the crankshaft rotates. Such a machine will be referred to as "of the type described".

In the more general case, the main axis of rotation of the crankshaft (or cam shaft as the case may be) will not normally occupy the same plane as the path of movement of the grinding wheel axis as the latter is moved towards and away from the workpiece, so that there is a constant height error to be taken into account. Effectively this introduces a degree of non-symmetry into the errors arising during the rotation of the crankshaft or cam shaft, which would generally be symmetrical if the workpiece axis and grinding wheel axis occupied the same plane as the path of movement of the grinding wheel axis towards and away from the workpiece.

It is an object of the present invention to provide a solution to this problem.

SUMMARY OF THE INVENTION

According to the present invention in a computer controlled grinding machine programmed so as to control the machine by calculating the wheelhead demand positions so as to grind the desired workpiece using appropriate parameters for the workpiece such as roundness, diameter, throw and taper (if required) based on the assumption that the workpiece axis and grinding wheel axis occupy the same plane as does the path of movement of the wheel axis towards and away from the workpiece, wherein the machine is also programmed to alter the wheelhead demand position during workpiece rotation to compensate for errors resulting from the varying height of the workpiece as the latter rotates, and wherein a demand position value is computed which takes into account the difference in height between the workpiece axis of rotation and the grinding wheel axis of rotation for each of a plurality of rotational positions of the workpiece around its axis and stored for each position, prior to grinding, and the wheelhead position demand signals employed during grinding of the workpiece are derived from the stored values.

If the difference in height between a crankshaft workpiece axis and the wheel axis is H, then in accordance with the invention, the demand position value (P) for each angular position of the workpiece A (measured in the direction of rotation of the workpiece around its main axis from a start position) is given by the following equation:

$$P=(T^* \cos A)+\sqrt{(R+r)^2-((T^* \sin A)+H)^2)} \quad (1)$$

Where:

R is the current radius of the grinding wheel, r is the target radius for the crankpin, and T is the throw of the crankpin around the main crankshaft axis.

Typically the grinding wheel rotates in one sense, e.g. clockwise, and the crankshaft rotates in the opposite sense, e.g. anti-clockwise, and the start position is when the grinding wheel is at its furthest (most rearward) position relative to the crankshaft axis, and the crankpin and crankshaft axes occupy the same horizontal plane.

Typically the computed value for P is calculated for each of 3600 positions during one revolution of the workpiece, ie from A=0 to $2\pi$ (which in the case of a rotating crankshaft results in turn in one revolution of the crankpin about its axis).

Preferably during grinding of the crankpin, the value for P is calculated at each of a succession of equally spaced apart points in time from the beginning of the grind, by using the appropriate value for P from the stored values of P, or where the angular position of the workpiece at any instant does not correspond precisely with an angular position at which a value for P has been stored, a value for P is computed by interpolating between the two adjoining stored values for P.

It has been found that a 0.1 millimeter height discrepancy H can result in a 1 micron roundness error, ie a 1 micron necking of what should otherwise be a circular cross-section.

The invention also lies in a computer controlled grinding machine as aforesaid in which the computer is loaded with a program and operated to calculate and store in a memory the demand position (P) for the wheelhead using and equation for (P) taking account of any non-circularity or non-concentric rotation of the workpiece, together with any difference in height between the workpiece and wheel axes, for each of a plurality of positions during one revolution of the workpiece, and the wheelhead feed is subsequently controlled by signals derived from the stored values of (P), during a subsequent grinding of the workpiece.

The invention also lies in a method of controlling the wheelhead of a computer controlled grinding machine so as to accommodate errors which would arise due to misalignment of the horizontal planes containing the wheel axis and the main axis about which the workpiece is rotated; wherein as a first step, a computer is loaded with a program which enables the instantaneous demand position for the wheelhead (P) to be calculated for each of N positions of the workpiece for a single revolution of the workpiece, and storing the computed value of (P), and as a second step, during grinding of the workpiece, computing the demand position for the wheelhead at each of a succession of equally spaced apart points in time from the start of grinding, by relating the time to the angular position of the workpiece and using the N stored values and interpolating between them where values for P required are intermediate the values stored for particular angular positions, and as a third step generating a demand position control signal for controlling the wheelhead during grinding using the stored and/or interpolated demand position values for P.

Preferably in the above method the value of P is recalculated at 1 ms intervals during the grinding.

The invention also lies in workpieces when ground using a grinding machine as aforesaid or a grinding machine operating in accordance with the above method.

The invention will now be described by way of example with reference to the accompanying drawing which illustrates in side elevation, a grinding wheel and crankpin workpiece.

In the drawing the grinding wheel 10 rotates about axis 12 and is mounted for fore and aft movement along path 14 to allow the wheel to engage and disengage a workpiece and in the case of an eccentric component such as a crankpin, to allow the wheel to follow the orbital path of the pin and maintain grinding engagement between wheel and pin, as the crankshaft containing the pin, itself rotates.

In the drawing, the main axis of the crankshaft is denoted by 16, and the pin being ground is denoted by 18, with its axis shown at 20.

The pin 16 is situated at the outboard end of a pair of crank-arms one of which is shown at 22.

The path 14 generally will be horizontal and ideally the crankshaft axis should lie in the same horizontal plane as the wheel axis 12 and path 14.

In the general case, for many different reasons, this will not be the case, and the perpendicular distance between the plane 24 (containing the wheel axis 12 and path 14) and the horizontal plane 26 containing the crankshaft axis 16, is identified by H.

In accordance with the invention, the demand position for the wheel 10 at each of a number of rotational positions of the crankshaft is computed prior to the commencement of grinding using the formula (2) above. The start position (where A=0) is where the straight line joining the crankshaft axis 16 and the pin axis 20 lies in the horizontal plane 26, with the pin 18 between the crankshaft axis 16 and the wheel 10.

During grinding, the crankshaft is rotated relatively slowly about its axis 16 so that in turn the crankpin is rotated around the crankshaft axis 16, while the wheel 10 rotates around its axis 12 at a relatively high speed, typically many thousands of revolutions per minute, and is advanced and retarded relative to the crankshaft so as to remain in contact with the pin in manner known per se.

In a preferred arrangement the demand position P is computed for 3600 equally circularly spaced positions of pin 18 around crankshaft axis 16, for a single rotation of the crankshaft between A=0 and A=360° (ie P is recalculated every 1/10° of a degree of rotation of the crankshaft) before grinding of the pins commences. During grinding at 1 msec intervals from the start of the grind, a value for P is computed by interpolating between the stored pre-calculated values, dependent in the angle A at each instant. The interpolated values for P are used to determine the signals required to determine the demand position for the wheelhead, using equation (1) above.

What is claimed is:

1. A computer controlled grinding machine programmed to grind a workpiece by calculating wheelhead demand positions based on workpiece parameters obtained by gauging the workpiece and computed on the assumption that the workpiece axis and grinding wheel axis occupy the same plane as does the path of movement of the wheel axis towards or away from the workpiece, characterised in that the machine is also programmed to alter the wheelhead demand positions during workpiece rotation to compensate for errors resulting from the varying height of the workpiece as it rotates, such that a demand position value is computed which also takes into account the difference in height between the workpiece axis of rotation and the grinding wheel axis of rotation for each of a plurality of rotational positions of the workpiece around its axis, and each demand position value is stored for each of the said positions prior to grinding, and the wheelhead position demand signals employed during grinding of the workpiece are derived from the stored values.

2. A computer controlled grinding machine as claimed in claim 1 adapted to grind a crankpin of a crankshaft, wherein the demand position value (P) for each angular position of the crankshaft A (measured in the direction of its rotation around its main axis from a start position) is computed using the following equation:

$$P=(T^* \cos A)+\sqrt{((R+r)^2-((T^* \sin A)+H)^2)}$$

where:

R is the current radius of the grinding wheel, r is the target radius for the crankpin, T is the throw of the crankpin around the main crankshaft axis, and H is the vertical height between the two axes (the height error).

3. A computer controlled grinding machine as claimed in claim 2 adapted to grind a crankpin of a crankshaft, wherein the grinding wheel rotates in one sense and the crankshaft rotates in the opposite sense and the start position for the grind is when the grinding wheel is at its furthest (most rearward) position relative to the crankshaft axis whilst still in contact with the pin, and the crankpin and crankshaft axes occupy the same horizontal plane.

4. A computer controlled grinding machine as claimed in claim 2 in which the computed value for P is calculated for each of 3600 positions during one revolution of the crankshaft, i.e. from A=0 to $2\pi$.

5. A computer controlled grinding machine as claimed in claim 2 wherein during grinding of the crankpin, the value for P is calculated at each of a succession of equally spaced apart points in time from the start of the grind, by using the appropriate value for P from the stored values of P, or where the angular position of the workpiece at any instant does not correspond precisely with an angular position at which a value of P has been stored, a value for P is computed by interpolating between the two adjacent stored values for P, and the computer is programmed accordingly.

6. A computer controlled grinding machine as claimed in claim 1 adapted to grind a crankpin of a crankshaft, wherein the grinding wheel rotates in one sense and the crankshaft rotates in the opposite sense and the start position for the grind is when the grinding wheel is at its furthest (most rearward) position relative to the crankshaft axis whilst still in contact with the pin, and the crankpin and crankshaft axes occupy the same horizontal plane.

7. A computer controlled grinding machine as claimed in claim 6 wherein during grinding of the crankpin, the value for P is calculated at each of a succession of equally spaced apart points in time from the start of the grind, by using the appropriate value for P from the stored values of P, or where the angular position of the workpiece at any instant does not correspond precisely with an angular position at which a value of P has been stored, a value for P is computed by interpolating between the two adjacent stored values for P, and the computer is programmed accordingly.

8. A computer controlled grinding machine as claimed in 6 in which the computed value for P is calculated for each of 3600 positions during one revolution of the crankshaft, i.e. from A=0 to $2\pi$.

9. A computer controlled grinding machine as claimed in claim 8 wherein during grinding of the crankpin, the value for P is calculated at each of a succession of equally spaced apart points in time from the start of the grind, by using the appropriate value for P from the stored values of P, or where the angular position of the workpiece at any instant does not correspond precisely with an angular position at which a value of P has been stored, a value for P is computed by interpolating between the two adjacent stored values for P, and the computer is programmed accordingly.

10. A method of controlling a computer controlled grinding machine characterised in that prior to the commencement of grinding (1) the computer is loaded with a program to calculate and store in a memory the demand position P for the wheelhead, using an equation for computing P taking into account any non-circularity or non-concentric rotation of the workpiece, together with any difference in height between the workpiece and wheel axes for each of a plurality of positions during one revolution of the workpiece, and (2) the wheelhead feed is subsequently controlled by signals derived from the stored values of P during grinding of the workpiece.

11. A method of controlling the wheel head of a computer controlled grinding machine so as to accommodate errors which would arise due to misalignment of the horizontal planes containing the axis about which the grinding wheel is rotated and the axis about which the workpiece is rotated, comprising the steps of (1) loading the computer with a program which enables the instantaneous demand position for the wheelhead P to be calculated for each of N positions of the workpiece for a single revolution of the workpiece, (2) storing the N computed values of P, (3) engaging the workpiece with the wheel and during the grinding of the workpiece computing the demand position for the wheelhead at each of a succession of equally spaced apart points in time from the start of grinding, (4) relating the time to the angular position of the workpiece and using the N stored values and interpolating between them where values for P are required which are intermediate the values stored for particular angular positions, and (5) generating a demand position control signal for controlling the wheelhead during the grinding using the stored and/or interpolated demand position values for P.

12. A method a claimed in claim 11 wherein the value of P is calculated at 1 ms intervals during the grinding.

* * * * *

UNITED STATES PATENT AND TRADEMARK OFFICE

CERTIFICATE OF CORRECTION

PATENT NO. : 6,733,364 B2
DATED : May 11, 2004
INVENTOR(S) : Selwyn Jonathan Griffiths It is certified that error appears in the above-identified patent and that said Letters Patent is hereby corrected as shown below:

Title page,
Item [57], ABSTRACT,
Line 8, "P=(T*¿ cosA)+√(R+r)2-((T*¿ sinA)+H)2)" should be
-- P=(T*cosA)+√((R+r)2 -((T*sinA)+H)2 ) --
Line 9, "eight" should be replaced with -- height --

Column 2,
Line 41, after "√" insert therein -- ( --

Column 5,
Line 33, after "claimed in" insert therein -- claim --

Column 6,
Line 41, after "A method" delete "a" and insert therein -- as --

Signed and Sealed this

Eighteenth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,733,364 B2
DATED : May 11, 2004
INVENTOR(S) : Selwyn Jonathan Griffiths It is certified that error appears in the above-identified patent and that said Letters Patent is hereby corrected as shown below:

Title page,
Item [22], PCT Filed, remove "Dec. 6, 2001" and insert therein -- Dec. 6, 2000 --

Signed and Sealed this

Third Day of May, 2005

JON W. DUDAS
*Director of the United States Patent and Trademark Office*